US006974127B2

(12) United States Patent
Kang

(10) Patent No.: US 6,974,127 B2
(45) Date of Patent: Dec. 13, 2005

(54) DRIVE APPARATUS FOR INK JET PRINTER

(75) Inventor: Sung-wook Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 155 days.

(21) Appl. No.: 10/724,167

(22) Filed: Dec. 1, 2003

(65) Prior Publication Data

US 2004/0109056 A1 Jun. 10, 2004

(30) Foreign Application Priority Data

Dec. 3, 2002 (KR) ..... 10-2002-70124

(51) Int. Cl.[7] ..... B65H 5/00

(52) U.S. Cl. ..... 271/10.11; 271/118; 271/114; 400/625

(58) Field of Search ..... 271/117, 118, 112, 271/114, 270, 111, 109, 10.11, 242; 400/625

(56) References Cited

U.S. PATENT DOCUMENTS 2,999,592 A * 9/1961 Brand ..... 209/549
4,577,849 A * 3/1986 Watanabe ..... 271/9.02
4,722,518 A * 2/1988 Watanabe ..... 271/9.05
4,865,305 A * 9/1989 Momiyama et al. ..... 271/116
5,547,181 A * 8/1996 Underwood ..... 271/114
5,624,196 A * 4/1997 Jackson et al. ..... 400/625
5,860,645 A * 1/1999 Tomura et al. ..... 271/10.13
5,882,002 A * 3/1999 Kamei et al. ..... 271/118
5,887,866 A * 3/1999 Yamauchi et al. ..... 271/116
5,967,504 A * 10/1999 Yankloski ..... 271/2
6,213,458 B1 * 4/2001 Tamura et al. ..... 271/10.11
6,312,093 B1 * 11/2001 Saijo et al. ..... 347/30
6,412,771 B1 * 7/2002 Hirata et al. ..... 271/116

* cited by examiner

*Primary Examiner*—Kathy Matecki
*Assistant Examiner*—Rakesh Kumar
(74) *Attorney, Agent, or Firm*—Staas & Halsey LLP

(57) ABSTRACT

A drive apparatus of an ink jet printer using a single motor in which convey failure does not occur by preventing power from being transferred to the convey roller when paper is fed by the feed roller. In an ink jet printer where a sheet of paper stacked in a paper feed cassette is picked up by a pickup roller, conveyed by a convey roller and a pinch roller, and then printed by a printer head while being line-fed by the feed roller, the drive apparatus includes a first gear train disposed on a feed roller shaft with the feed roller assembled to swing within a predetermined angle on the feed roller shaft in a feed roller shaft rotation direction, a second gear train disposed on a frame of the ink jet printer to be in contact with the first gear train, and a third gear train with a front end gear connected with the rear end gear of the second gear train and a rear end gear coaxially disposed on a convey roller shaft with the convey roller assembled. The third gear train swings within a predetermined angle on a front end gear shaft with the front end gear assembled in a feed roller rotation direction. A control unit controls the first gear train and the second gear train to separate from each other by the entrance of the paper into the feed roller so that the driving power is blocked to the convey roller.

32 Claims, 8 Drawing Sheets

DRIVE APPARATUS FOR INK JET PRINTER

CROSS-REFERENCE TO RELATED APPLICATIONS

This application claims the benefit of Korean Application No. 2002-76124, filed Dec. 3, 2002, in the Korean Intellectual Property Office, the disclosure of which is incorporated herein by reference.

BACKGROUND OF THE INVENTION

1. Field of the Invention

The present invention relates to a drive apparatus for an ink jet printer, and more particularly, to a drive apparatus for an ink jet printer using a single motor in which a pickup roller and a convey roller are not powered while a feed roller line-feeds a sheet of paper.

2. Description of the Related Art

Generally, an ink jet printer having a paper feeding direction that is similar to a paper discharge direction, namely a front-insert-front-out (FIFO) type ink jet printer, has a convey roller disposed between a pickup roller and a feed roller to convey picked up paper to the feed roller.

An example of such ink jet printer is shown in FIG. 1. Referring to FIG. 1, the ink jet printer comprises a paper feed cassette 10, a pickup roller 20, a convey roller 30, a feed roller 40, and a printer head 50. The convey roller 30 is rotatably disposed opposite to a pinch roller 31 and the pinch roller 31 is resiliently supported by a pinch spring 32 thereby applying pressure to the convey roller 30 with a predetermined force.

A plurality of sheets 11 stacked in the paper feed cassette 10 is separated sheet-by-sheet by the pickup roller 20 and a separating wall 12, and the separated sheet 11 enters between the convey roller 30 and the pinch roller 31 along the separating wall 12. The sheet 11' entered between the convey roller 30 and the pinch roller 31 is conveyed to the feed roller 40 by the rotation of the convey roller 30. Having entered to the feed roller 40, the sheet 11' is conveyed to below the printer head 50 by the rotation of a friction roller 41 disposed above the feed roller 40. A paper guide 52 is disposed below the printer head 50, and the sheet 11' enters between the printer head 50 and the paper guide 52. When the sheet 11' is positioned on the paper guide 52, the printer head 50 sprays ink traveling along a guide bar 51 by a moving belt 53 thereby printing an image on the sheet 11'. When the printing is completed, the sheet 11' with an image printed thereon is disposed outside by a discharge roller 60.

The feed roller 40 feeds the sheet 11' onto the paper guider 52 in increments that are as wide as the width of a swath of ink droplets the printer head 50 is able to print, stops until the corresponding swath is completely printed by the printer head 50, and repeats feeding the sheet 11' in increments (hereinafter called line-feeding). Accordingly, the feed roller 40 is driven by a separate motor and the rotating angle of the feed roller 40 is precisely controlled by a rotation detecting sensor such as a rotary encoder.

Recently, however, a development has been made to provide an ink jet printer which removed a motor to drive the convey roller 30 and added a power transferring apparatus (not shown) to transfer power of the feed roller 40 to the convey roller 30 thereby driving the feed roller 40 and the convey roller 30 using a single motor.

Although the driving mechanism of an ink jet printer using a single motor to drive the convey roller 30 and the feed roller 40 theoretically has the same driving speed for the feed roller 40 and the convey roller 30, in practice the speeds of the paper passing the feed roller 40 and the convey roller 30 are often different. That is, when a sheet of paper is simultaneously passing the feed roller 40 and the convey roller 30, the sheet may be exposed to tension and compression depending on the speed of each the feed roller 40 and the convey roller 30. That is because the coefficient of friction of the surfaces of the feed roller 40 and the convey roller 30 can not be absolutely equal and mechanical errors such as backlash in the power transferring apparatus transferring power from the motor to the convey roller 30 and the feed roller 40 are different.

If the sheet of paper fed by the feed roller is affected by the convey roller, line-feeding of the sheet of paper by the feed roller cannot be controlled precisely as convey failure occurs while the feed roller conveys the sheet of paper. The convey failure occurs as a sheet of paper slips between the feed rollers due to the difference in speed between the feed roller and the convey roller. If the sheet of paper is not line-fed precisely by the feed roller, printing quality may be impaired. Therefore, in order to improve printing quality of an ink jet printer with the feed roller and the convey roller driven by a single motor, it is necessary to not to transfer power to the convey roller thereby preventing the convey roller from rotating while the feed roller line-feeds a sheet of paper.

SUMMARY OF THE INVENTION

Accordingly, an aspect of the present invention provides a drive apparatus of an ink jet printer in which a sheet of paper stacked in a paper feed cassette is picked up by a pickup roller, conveyed by a convey roller and a pinch roller, and then printed by a printer head while being line-fed by the feed roller, which includes a first gear train disposed on a feed roller shaft with the feed roller assembled to swing within a predetermined angle on the feed roller shaft in a feed roller shaft rotation direction, a second gear train disposed on a frame of the ink jet printer to be in contact with the first gear train, a third gear train with a front end gear connected with the rear end gear of the second gear train and a rear end gear coaxially disposed on a convey roller shaft with the convey roller assembled, the third gear train swinging within a predetermined angle on a front end gear shaft with the front end gear assembled in a feed roller rotation direction, and a control unit controlling the first gear train and the second gear train to separate from each other by the entrance of the paper into the feed roller so that the driving power is blocked to the convey roller.

The first gear train includes a first swing arm with one end rotatably assembled on the feed roller shaft and the other end provided with a protruding second gear shaft, a first gear integrally assembled on the feed roller shaft to rotate together with the feed roller shaft, and a second gear engaged with the first gear and rotatably assembled on the second gear shaft.

A friction member is disposed between a side of the second gear and the first swing arm.

The friction member uses a compression spring or a curve spring.

The second gear train includes a third gear rotatably assembled on a third gear shaft protruding on the frame and engaged with the rear end gear of the first gear train, and a fourth gear disposed to rotate in engagement with the third gear.

The third gear train includes a second swing arm with one end rotatably assembled on the convey roller shaft with the convey roller assembled and the other end provided with a protruding fifth gear shaft, a sixth gear integrally assembled on the convey roller shaft to rotate together, and a fifth gear assembled to rotate on the fifth gear shaft and be engaged with the sixth gear and receiving a rotation force from the rear end gear of the second gear train.

A friction member is disposed between a side of the sixth gear and the second swing arm.

Further provided is a seventh gear engaged with the rear end gear of the third gear train when the convey roller comes in contact with the pinch roller thereby conveying the sheet of paper to the feed roller.

A friction member is disposed on a side of the seventh gear.

The third gear train includes a plurality of supporting arms rotatably supporting both ends of a convey roller shaft of the convey roller, an extension shaft connecting the plurality of supporting arms, a front end gear rotatably assembled at one end of the extension shaft and engaged with the rear end gear of the second gear train, and a rear end gear integrally assembled on the convey roller shaft to rotate together.

According to another embodiment of the present invention, a drive apparatus of an ink jet printer in which a sheet of paper stacked in a paper feed cassette is picked up by a pickup roller, conveyed by a convey roller and a pinch roller, and then printed by a printer head while being line-fed by the feed roller, include a motor, a reduction gear to reduce speed of the motor, a feed gear disposed at one side of a feed roller shaft with the feed roller assembled and engaged with the reduction gear, a plurality of first gear trains disposed on both sides of the feed roller shaft, the plurality of first gear trains swinging within a predetermined angle around the feed roller shaft in a feed roller shaft rotation direction, a plurality of second gear trains engaged with a rear end gear of the plurality of first gear trains to transmit a rotation force of the feed roller shaft, a plurality of third gear trains with one end connected with a rear end gear of the plurality of second gear trains and the other end coaxially connected with a convey roller shaft with the convey roller assembled, the plurality of third gear trains swinging within a predetermined angle on a front end gear shaft with the front end gear assembled in a feed roller rotation direction, a pickup shaft integrally assembled on a front end gear of the plurality of the second gear train to rotate together, and a pickup roller unit with one end assembled on the pickup shaft and the other end pressing upper surface of sheets of paper stacked in the paper feed cassette. When the feed roller rotates in a direction the sheet of paper is conveyed to the printer head, the first gear train is separated off the second gear train thereby preventing the pickup roller unit from rotating, and the convey roller coaxially connected with a front end gear of the third gear train pivots downward on a front end gear shaft of the third gear train thereby being separated off the pinch roller.

According to the drive apparatus of an ink jet printer in the present invention, convey failure does not occur in an ink jet printer driving the feed roller and the convey roller by a single motor, as power is not transferred to the convey roller while the feed roller feeds the paper.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
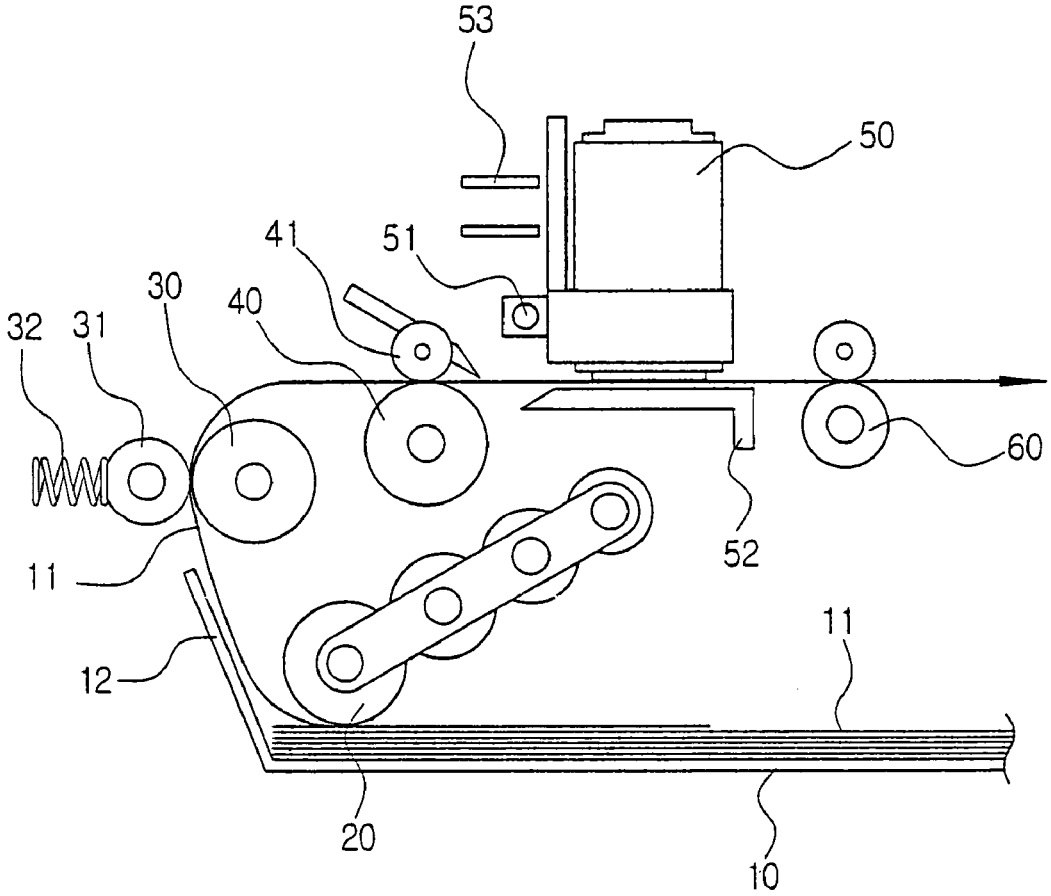
FIG. 1 (PRIOR ART)
FIG. 1 is a sectional side view schematically showing a structure of an ink jet printer comprising a conventional drive apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, a drive apparatus of an ink jet printer according to a preferred embodiment of the present invention will be described in greater detail with reference to the accompanying drawings.

Figure 2:
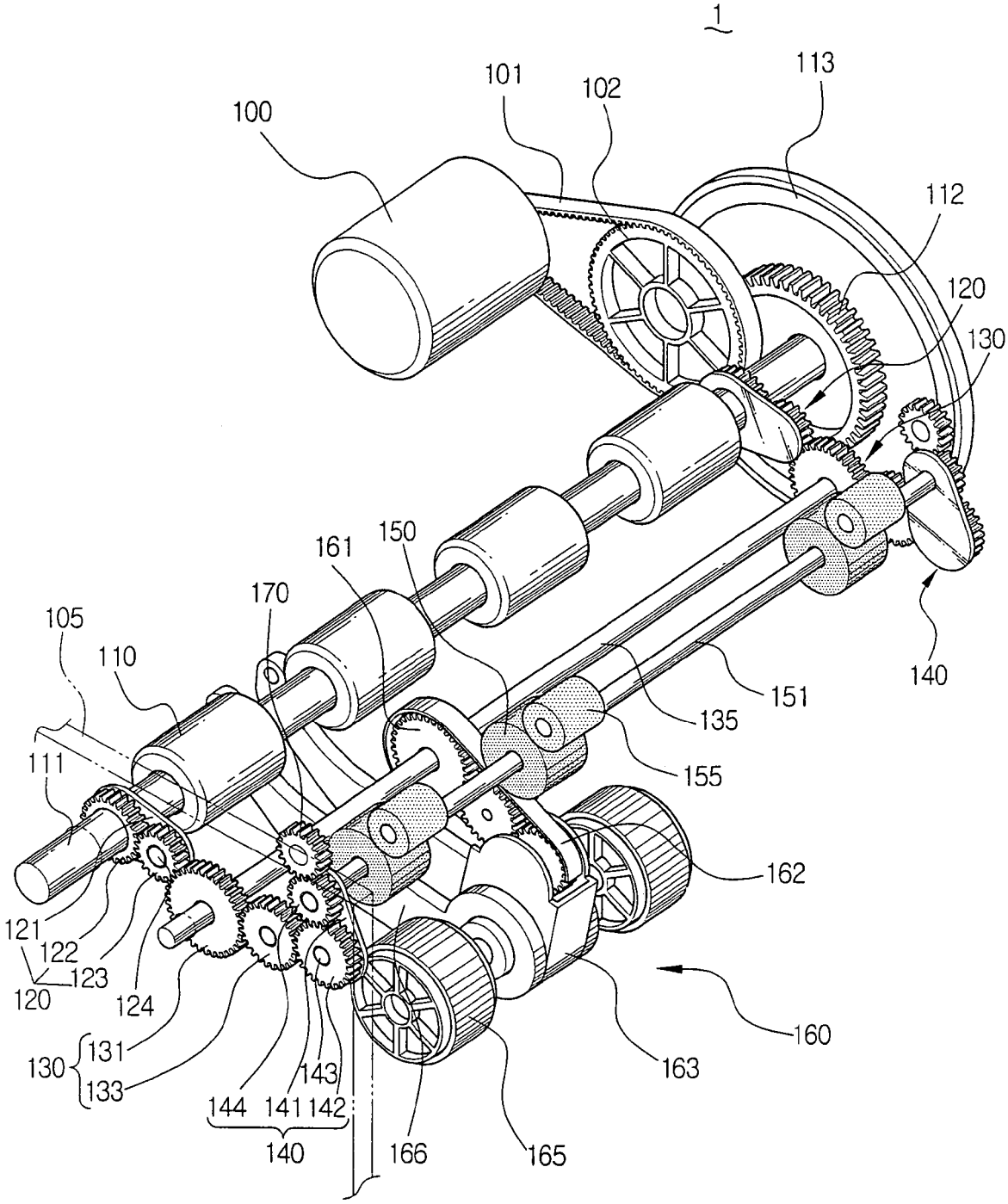
FIG. 2 is a perspective view showing a drive apparatus of an ink jet printer according to the present invention.

Referring to FIG. 2, a drive apparatus 1 of an ink jet printer according to the present invention comprises a motor 100, a feed roller 110, a first gear train 120, a second gear train 130, a third gear train 140, a convey roller 150, and a pickup roller unit 160.

The motor 100 is a power source to drive a drive apparatus of an ink jet printer and generally uses a DC motor.

In order to transfer power of the motor 100 to the feed roller 110, a reduction gear 102 is provided in between the motor and the feed roller 110. The reduction gear 102 has a pulley and a gear integrally formed, and the diameter of the pulley of the reduction gear is larger than that of the pulley (not shown) assembled to a shaft of the motor 100 thereby transmitting the rotation of the motor 100 with the speed reduced. In addition, the gear (not shown) of the reduction gear 102 is engaged with the feed gear 112 thereby transmitting the rotation of the motor 100 to the feed gear 112. The diameter of the feed gear 112 is larger than that of the gear of the reduction gear 102 and therefore once again reduced rotation speed is transmitted to the feed gear 112.

The feed roller 110 line-feeds a sheet of paper to below a printer head 50 (see FIG. 1) by the power received from the motor 100 allowing printing. The feed roller 110 is disposed around the feed roller shaft 111 and at one side of the feed roller shaft 111, assembled is the feed gear 112 mentioned above. On the outer side of the feed roller shaft 111, an encoder 113 is disposed to detect a rotation angle of the feed roller 110. Both ends of the feed roller shaft 111 are supported by a frame (not shown) of the ink jet printer. The frame houses, and thus supports a feed cassette 10 (see FIG. 1) therein and supports movement elements such as the feed roller shaft 111 or a printer head so that they can stably operate maintaining space with each other.

The first gear train 120 comprises a first swing arm 121, a first gear 122 and a second gear 123. The first swing arm 121 has one end freely and rotatably disposed around the feed roller shaft 111 and the other end provided with a protruding second gear shaft 124. The first gear 122 is integrally formed with the feed roller shaft 111 so as to rotate with the feed roller shaft 111 at the same speed. The second gear 123 is engaged with the first gear 122 and freely and rotatably disposed around the second gear shaft 124 of the first swing arm 121. Accordingly, when the first gear 122 rotates in certain direction, the second gear 123 rotates and therefore the first swing arm 121 swings around the feed roller shaft 111 (hereinafter, called a swing movement) by a predetermined angle in the first gear 122 rotation direction. When the first gear 122 swings in the opposite direction, the first swing arm 121 swings also in the opposite direction by a predetermined angle. That is, the first swing arm 121 swings within a predetermined scope of angle according to the rotation of the first gear 122. In order to ensure the swing movement of the first swing arm 121 by the rotation of the first gear 122, in one embodiment of the invention a friction member 125 (see FIG. 3) is provided between the second gear 123 and the first swing arm 121. The friction member 125 uses a compression spring or a curve spring in order to apply a predetermined pressure to the second gear 123. Although the first gear train 120 comprises two gears in the present description, the first gear train 120 may also comprise three or more gears. In the structure of a first gear train comprising three or more gears, the first gear 122 described above corresponds to the front end gear of the first gear train and the second gear 123 corresponds to the rear end gear of the first gear train. Except for an idle gear disposed between the front end gear and the rear end gear, the structure of the first gear train is same as above.

The first gear train 120 may be disposed at one end of the feed roller shaft 111 but may also be disposed at both ends of the feed roller shaft 111 as shown in FIG. 2. The first gear train 120 disposed at the side where the feed gear 112 is disposed on the feed roller shaft 111 between the feed roller 110 and the feed gear 112.

The second gear train 130 comprises a third gear 131 and a fourth gear 133. The third gear 131 is disposed at one end of a pickup shaft 135 and integrally rotates with the pickup shaft 135. The fourth gear 133 is disposed between the third gear 131 and a fifth gear 142 of a third gear train 140 which will be described later thereby transmitting power of the third gear 131 to the fifth gear 142. Although the second gear train 130 comprises two gears in the above described embodiment, it may also comprise three or more gears. In the structure of the second gear train 130 comprising three or more gears, the third gear 131 described above corresponds to the front end gear of the second gear train and the fourth gear 133 corresponds to the rear end gear of the second gear train. An idle gear is disposed between the front end gear and the rear end gear of the second gear train.

The number of the second gear train 130 may vary depending on the number of the first gear train 120 disposed but may include two second gear trains corresponding to the number of first gear train 120 as in the embodiment described above. In case two second gear trains are disposed, two third gears 131 are respectively disposed at both ends of the pickup shaft 135 and the rotation of the pickup shaft 135 is supported by the frame of the ink jet printer.

The third gear train 140 comprises a second swing arm 141, a fifth gear 142, and a sixth gear 144. The second swing arm 141 has one end freely and rotatably disposed around a convey roller shaft 151 and the other end provided with a protruding fifth gear shaft 143. In addition, the fifth gear shaft 143 is rotatably supported by a frame 105. The fifth gear 142 is freely and rotatably disposed around the fifth gear shaft 143 and engaged with the fourth gear 133 of the second gear train 130. The sixth gear 144 is integrally formed with the convey roller shaft 151 at one end so as to rotate with the convey roller shaft 151 and engaged with the fifth gear 142. Thus, when the fifth gear 142 rotates in certain direction, the sixth gear 144 rotates and the second swing arm 141 swings around the fifth gear shaft 143 by a predetermined angle in the fifth gear 142 rotation direction. When the fifth gear 142 swings in the opposite direction, the second swing arm 141 swings also in the opposite direction by a predetermined angle. That is, the second swing arm 141 swings within a predetermined scope of angle according to the rotation of the fifth gear 142. In order to ensure the swing movement of the second swing arm 141 by the rotation of the fifth gear 142, a friction member 145 (see FIG. 3) is provided between the sixth gear 144 and the second swing arm 141. The friction member 145 uses a compression spring or a curve spring in order to apply a predetermined pressure to the sixth gear 144. Although the third gear train 140 comprises two gears in the present description, the third gear train 140 may also comprise three or more gears. In the structure of a third gear train comprising three or more gears, the fifth gear 142 described above corresponds to the front end gear of the third gear train and the sixth gear 144 corresponds to the rear end gear of the third gear train. Except for an idle gear disposed between the front end gear and the rear end gear, the structure of the third gear train is same as above.

The number of the third gear train 140 may vary depending on the number of the first gear train 120 and the second gear train 130, but in an embodiment of the invention, two second gear trains correspond to the number of first gear train 120 and the second gear train 130 as in the preferred embodiment described above. In case two second gear trains 130 are disposed, two sixth gears 144 are respectively disposed at both ends of the convey roller shaft 151.

The convey roller 150 is disposed to be in contact with a pinch roller 155 and conveys a sheet of paper picked up by the pickup roller 165 and entered between the convey roller 150 and the pinch roller 155 to the feed roller 110. The convey roller 150 is integrally disposed on the convey roller shaft 151 and the convey roller shaft 151 has the sixth gear 144 integrally assembled at both ends. In addition, the second swing arm 141 has one end assembled on the convey roller shaft 151 between the sixth gear 144 and the convey roller 150 and is disposed not to rotate even when the convey roller shaft 151 rotates. Therefore, when the fifth gear 142 rotates, the sixth gear 144 rotates thereby rotating the convey roller shaft 151 and the convey roller 150 together while being supported by one end of the second swing arm 141. When the fifth gear 142 rotates, the second swing arm 141 swings up and down around the fifth gear shaft 143 thereby lifting and lowering the convey roller 150. The convey roller 150 is swung up about the fifth gear shaft 143 to collide with the pinch roller 155 and thus rotate in contact with the pinch roller 155.

Figure 3:
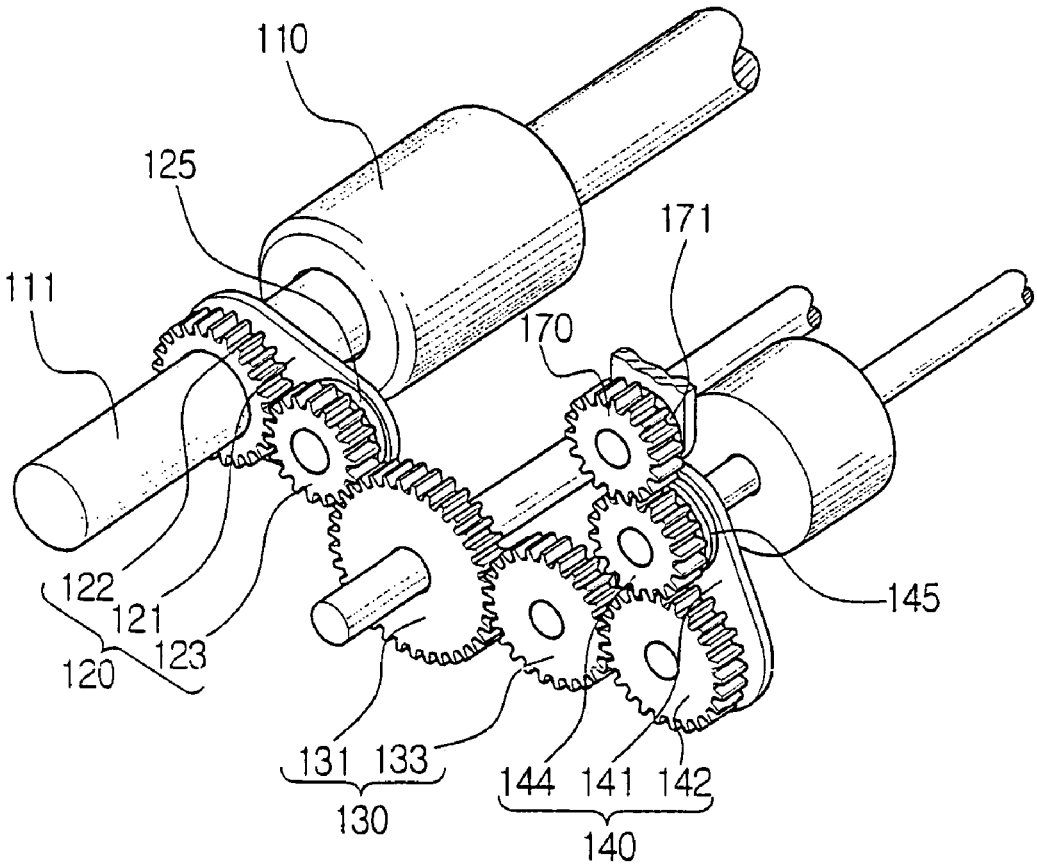
FIG. 3 is a partial perspective view showing the location of a friction member disposed in a first gear train and a third gear train in a drive apparatus of an ink jet printer of FIG. 2.

Referring to FIG. 3, seventh gear 170 is provided to be engaged with the sixth gear 144 of the third gear train 140 when the convey roller 150 comes in contact with the pinch roller 155 as the second swing arm 141 swings up. The seventh gear 170 is disposed to be engaged with the sixth gear 144 integrally assembled with the convey roller shaft 151 in the opposite of the fifth gear 142 with the sixth gear 144 in the middle thereby preventing the convey roller 150 from being separated off the pinch roller 155 by its own weight. Thus, the seventh gear 170 is supported by a friction member 171 (FIG. 3) disposed on the side of the seventh gear 170 so that the seventh gear 170 can support itself from the weight of the convey roller 150. The friction member 171 also uses a compression spring or a curve spring as those used for the first swing arm 121 and the second swing arm 141 described above. The number of the seventh gear 170 is determined to correspond to the number of the third gear train 140.

Referring to FIG. 2, the pickup roller unit 160 receives power from the motor 100, separates sheets 11 stacked in the paper feed cassette 10 sheet by sheet, and conveys the separated paper to the convey roller 150. The pickup roller unit 160 comprises a pickup gear 161 assembled on the pickup shaft 135 to rotate as the pickup shaft 135 rotates, an upper housing 162 with a plurality of gears disposed inside, a lower housing 163 assembled at one end of the upper housing 162 to rotate freely, and a pickup roller 165 assembled at the lower end of the lower housing 163. The pickup roller unit 160 operates in which when the pickup shaft 135 rotates, the pickup gear 161 rotates and accordingly the gears inside the upper housing 162 and the lower housing 163 rotate thereby rotating the pickup roller 165. In addition, since the pickup roller unit 160 is articulated by a pickup roller supporting arm 166 rotatably disposed to the frame, the upper housing 162 and the lower housing 163, it can always maintain in contact with the uppermost sheet 11 by its own weight even when the height of the sheets 11 stacked in the paper feed cassette 10 is lowered as the pickup roller 165 feeds the sheets 11.

Figure 7:
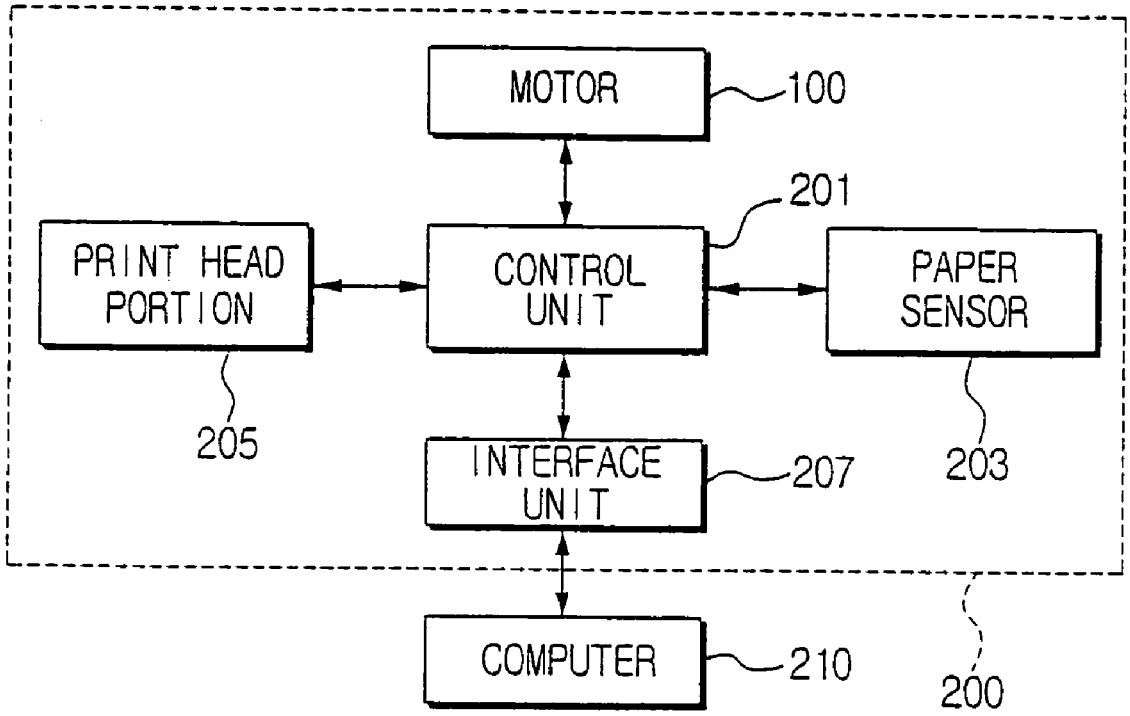
FIG. 7 is a control block diagram of a drive apparatus of an ink jet printer according to the present invention.

Referring to FIG. 7, a control unit 201, controls the rotation direction of the motor 100. The control unit 201 controls the rotation direction of the motor 100 in accordance with the signals received from the paper sensor 203. The control unit 201 also controls the print head portion 205. In FIG. 7, a reference numeral 207 denotes an interface unit and 210 denotes a computer.

Hereinafter, the operation of the drive apparatus of an ink jet printer having the above described structure will be described referring to FIGS. 2 through 5.

Figure 4:
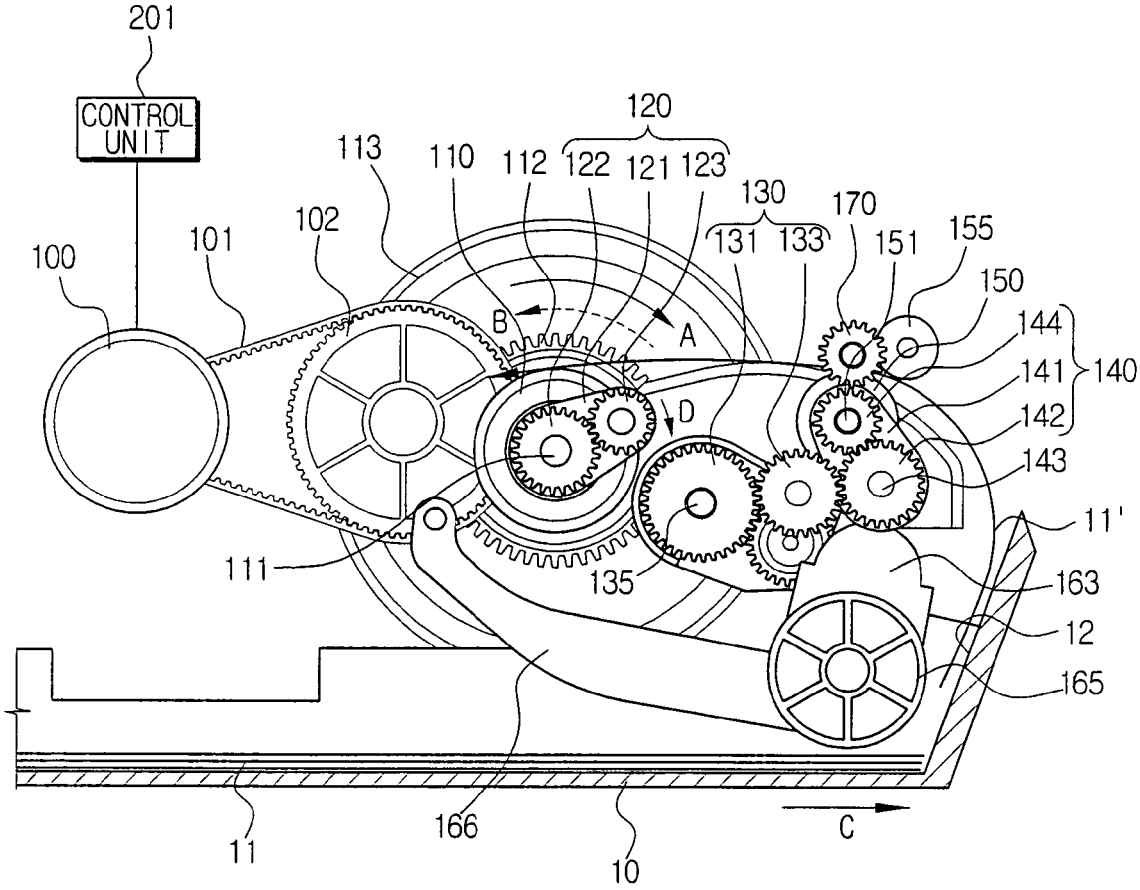
FIG. 4 is a sectional view showing gear trains of the drive apparatus of an ink jet printer of FIG. 2 when a feed roller line-feeds a sheet of paper.
Figure 5:
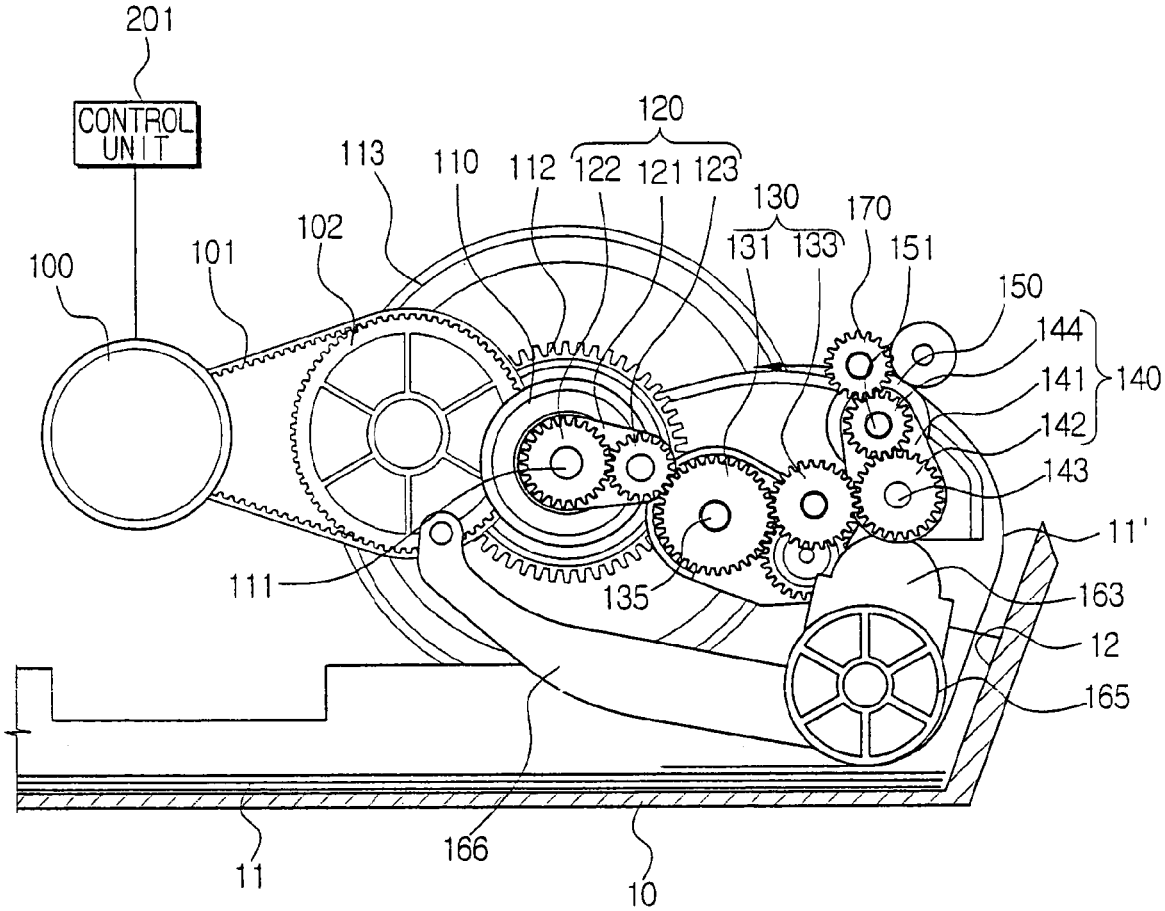
FIG. 5 is a sectional view showing gear trains of the drive apparatus of an ink jet printer of FIG. 2 when a sheet of paper is picked up and conveyed to the feed roller.

FIG. 4 is a sectional view showing the drive apparatus of an ink jet printer when a feed roller line-feeds a sheet of paper. When line-feeding is completed by the feed roller 110, the motor 100 reverses in the direction where the feed roller 110 rotates opposite the paper convey direction, thereby rotating the feed roller 110 clockwise (arrow A in FIG. 4). When the motor 100 reverses, the rotation of the motor 100 is transmitted to the feed gear 112 after having the speed reduced by the reduction gear 102. When the feed gear 112 rotates, the feed roller shaft 111 coaxially connected with the feed gear 112 also rotates clockwise. When the feed roller shaft 111 rotates clockwise, the first gear 122 also rotates clockwise thereby rotating the second gear 123 counter-clockwise. Then, the first swing arm 121 rotates clockwise (arrow D in FIG. 4) whereby the second gear 123 being engaged with the third gear 131.

When the second gear 123 is engaged with the third gear 131, power of the motor 100 is transmitted to the third gear 131 thereby rotating the third gear 131, and when the third gear 131 rotates, the pickup shaft 135 integrally assembled with the third gear 131 rotates. As the pickup shaft 135 rotates, the pickup gear 161 rotates, and therefore the rotation is transmitted to the pickup roller 165 through the gears inside the upper housing 162 and the lower housing 163 and the pickup roller 165 rotates counter-clockwise. When the pickup roller 165 rotates counter-clockwise, the sheet 11 pressed by the pickup roller 165 is slid in the direction indicated by the arrow C by the friction between the sheet 11 and the pickup roller 165, and the uppermost sheet conveyed to the convey roller 150 after being separated from other sheets by the separating wall 12.

In addition, when the second gear 123 is engaged with the third gear 131, power of the second gear 123 is transmitted through the third gear 131 to rotate the fourth gear 133. When the fourth gear 133 rotates, the fifth gear 142 always engaged with the fourth gear 133 starts to rotate. If the second gear 123 rotates counter-clockwise, the fifth gear 142 rotates clockwise.

When the fifth gear 142 rotates clockwise, the sixth gear 144 being engaged with the fifth gear 142 rotates counter-clockwise and then the convey roller 150 pivots upward since the second swing arm 141 rotates clockwise on the fifth gear shaft 143. The convey roller 150 pivoted upward due to the second swing arm 141 stops in the state that the convey roller 150 is in contact with the pinch roller 155. (FIG. 5) As the sixth gear 144 continues rotating in that state by the fifth gear 142, the convey roller 150 rotates while it is in contact with the pinch roller 155 thereby conveying the sheet 11' which entered between the convey roller 150 and the pinch roller 155 by the pickup roller 165 to the feed roller 110. The convey roller 150 and the pinch roller 155 during that stage are able to stably convey the sheet 11' without being separated from each other because the sixth gear 144 of the second swing arm 141 is supported by the seventh gear 170.

When the sheet 11' conveyed by the convey roller 150 enters between the feed roller 110 and the friction roller 41 (FIG. 1), the rotation direction of the motor 100 is shifted by the control unit 201, and accordingly, the feed roller 110 is rotated counter-clockwise (phantom arrow B in FIG. 4) thereby conveying the entered sheet 11' to the printer head 50. (FIG. 1) When the feed roller 110 rotates counter-clockwise, the first gear 122 disposed at one end of the feed roller shaft 111 rotates counter-clockwise thereby rotating the second gear 123 clockwise. Then, by the reverse rotation of the second gear 123, the first swing arm 121 pivots counter-clockwise on the feed roller shaft 111 and thus the second gear 123 is separated off the third gear 131 (FIG. 4). When the second gear 123 is separated off the third gear 131, power of the motor 100 is not transmitted to the third gear 131 and therefore the pickup roller 165 connected with the third gear 131 does not rotate. In addition, when the third gear 131 does not rotate, the fifth gear 142 which rotates the second swing arm 141 clockwise also stops thereby allowing the second swing arm 141 to pivot counter-clockwise by the weight of the convey roller 150. When the second swing arm 141 rotates counter-clockwise, the convey roller 150 is separated off the pinch roller 155.

As described above, when the motor 100 rotates in one direction and the feed roller 110 line-feeds the sheet 11', the convey roller 150 and the pickup roller 165 do not rotate whereas when the motor 100 reverses, the convey roller 150 and the pickup roller 165 rotate thereby picking up a sheet 11 stacked in the paper feed cassette 10 and conveying the sheet to the feed roller 110. Accordingly, convey failure due to the difference of the rotation speed between the convey roller 150 and the feed roller 110 does not occur.

Figure 8:
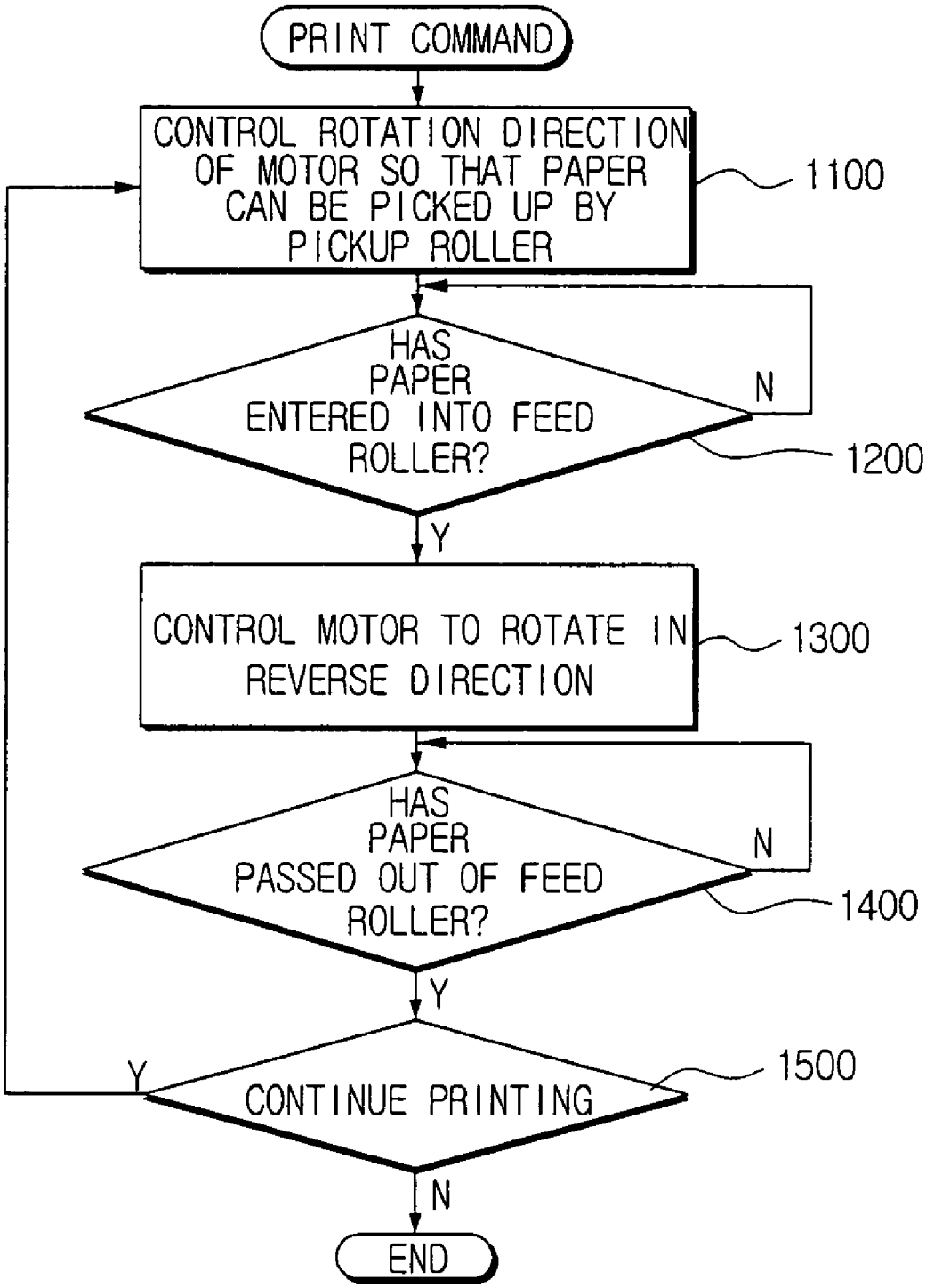
FIG. 8 is a flowchart illustrating a paper conveying method of a drive apparatus of an ink jet printer according to the present invention.

The controlling of the rotation direction of the motor 100 by the control unit 201 of the drive apparatus according to the present invention will be described below with reference to FIGS. 7 and 8.

In accordance with a print command, first, the control unit 201 controls the rotation direction of the motor 100 in the direction that enables the pickup roller 165 to pick up the paper sheet (1100). Accordingly, as the power is transmitted by the driving of the motor 100, the picked-up paper is entered to the convey roller 150.

As the paper reaches the feed roller 110, the paper sensor 203 senses the paper entering the feed roller 110 and input to the control unit 201 (1200). The control unit 201 then controls the rotation direction of the motor 100 to reverse (1300). As the rotation direction of the motor 100 shifts, the power is transmitted in the way as described above, so that the power is blocked to the convey roller 150 and the pickup roller 165, while the feed roller 110 is rotatably driven in the paper convey direction to line-feed the paper.

When the line-fed paper is sensed as being passed out of the feed roller 110 by the paper sensor (1400), the control unit 201 determines whether there is any print command or not (1500), and if yes, continues to perform operation 1100. The control unit 201 ends the operation if there is no print command.

In the above, a drive apparatus of an ink jet printer having a structure in which a shaft connecting two second swing arms disposed on both ends of a convey roller interferes with a pickup roller unit as the pickup roller unit is articulated was described.

Another embodiment of the present invention relates to a drive apparatus of an ink jet printer having a structure in which the shaft connecting two second swing arms described above do not interfere with the pickup roller unit. An example of such drive apparatus is shown in FIG. 6.

Figure 6:
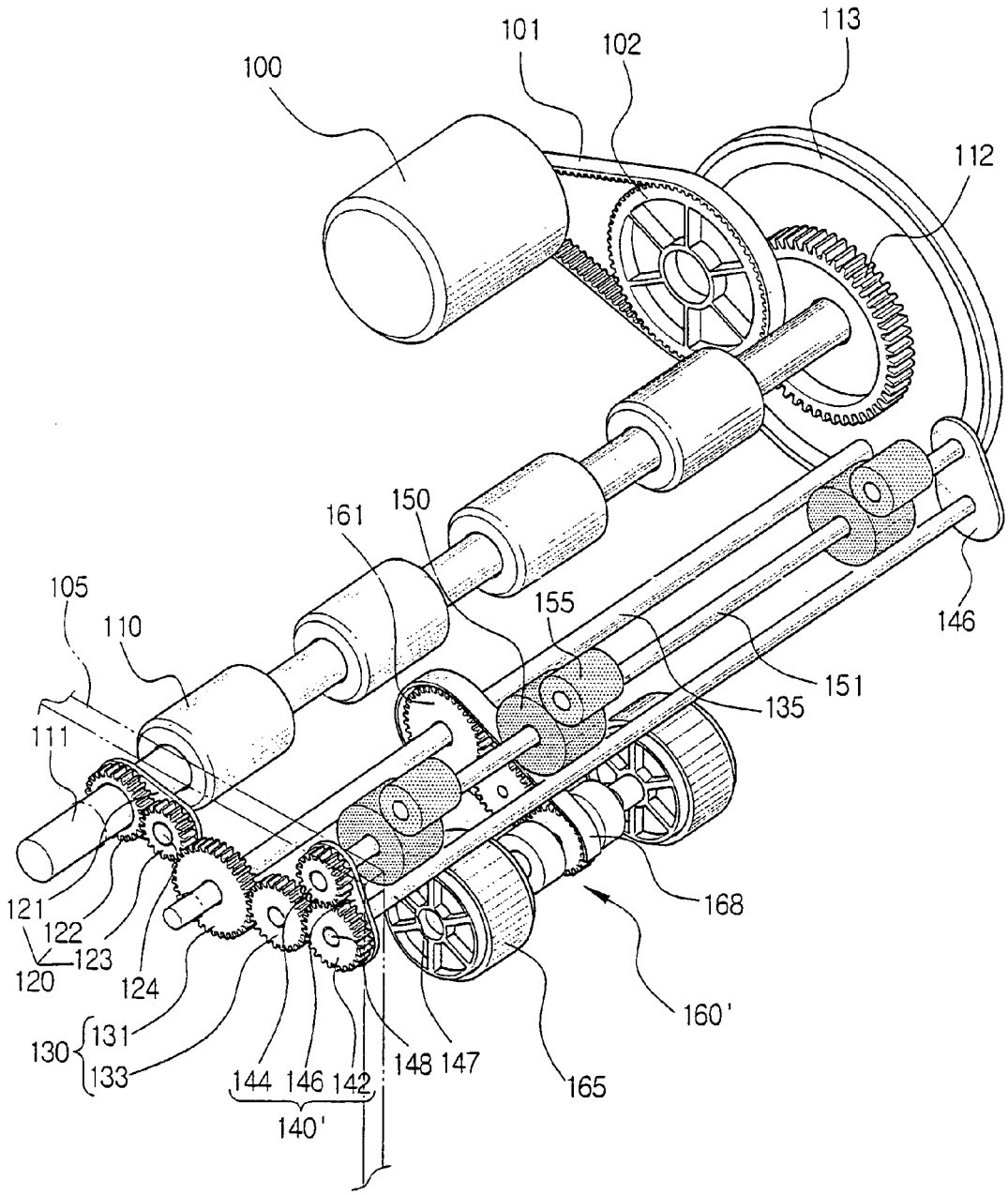
FIG. 6 is a perspective view showing another embodiment of a drive apparatus of an ink jet printer according to the present invention.

Referring to FIG. 6, the drive apparatus of an ink jet printer according to another embodiment of the present invention comprises a feed roller 110, a first gear train 120, a second gear train 130, a third gear train 140', a convey roller 150, and a pickup roller unit 160'.

The third gear train 140' comprises two supporting arms 146, an extension shaft 147, a fifth gear 142, and a sixth gear 144. The supporting arm 146 has one end assembled on the convey roller shaft 151 to rotate freely, and the other end assembled with an extension shaft 147 to integrally connect the two supporting arms 146. That is, the convey roller shaft 151 is assembled on the open side of an open frame formed by the two supporting arms 146 and the extension shaft 147 forming a rectangular shape. In addition, protruding gear shafts 148 are provided on the outer side of the two supporting arms 146, and the protruding gear shafts 148 are rotatably supported by an ink jet printer frame 105. The fifth gear 142 and the sixth gear 144 are assembled on one of the supporting arm 146 disposed on the side to which power of the motor 100 is transmitted. The fifth gear 142 is rotatably disposed on the gear shaft 148 protruding on the outer side of the supporting arm 146, and the sixth gear 144 is integrally assembled on the convey roller shaft 151 to rotate together with the convey roller shaft 151 and engage with the fifth gear 142. Accordingly, when the fifth gear 142 rotates, the sixth gear 144 also rotates and the supporting arm 146 pivots in the rotation direction of the fifth gear 142 around the extension shaft 147.

A detailed description of the structure of the first gear train 120 and the second gear train 130 will be omitted as it is same as the structure in the above described embodiment.

The pickup roller unit 160' has a structure in which the pickup roller 165 does not interfere with the extension shaft 147 even when the maximum number of sheets 11 are stacked in the paper feed cassette 10. (FIG. 3) In case of the present embodiment, the pickup gear 161 connected with the pickup shaft 135 and the pickup roller 165 are connected with each other by a gear housing 168 formed in a straight line. Accordingly, when the pickup shaft 135 rotates, the pickup gear 161 rotates thereby rotating the pickup roller 165 via the gears inside the gear housing 168. When the height of the stacked sheets 11 is lowered by the pickup roller 165, the pickup roller 165 is lowered by its own weight thereby always maintaining in contact with the sheets 11.

The second embodiment of the drive apparatus of an ink jet printer according to the present invention is identical to the first embodiment in the method in which power to the convey roller 150 and the pickup roller 165 is transmitted by swinging movement of the first swing arm 121 of the first gear train 120 except that the number of the first gear train 120, the second gear train 130 and the third gear train 140' are different. Therefore, a detailed description of the second embodiment will be omitted.

According to the drive apparatus of an ink jet printer of the present invention, convey failure due to the difference of the rotation speed between the convey roller 150 and the feed roller 110 does not occur as the convey roller does not convey paper during line-feeding by the feed roller. Therefore, deterioration of printing quality due to convey failure will not occur.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A drive apparatus of an ink jet printer, including a frame, in which a sheet of paper stacked in a paper feed cassette is picked up by a pickup roller, conveyed by a convey roller and a pinch roller, and then printed by a printer head while being line-fed by a feed roller, the drive apparatus comprising:

a first gear train, disposed on a feed roller shaft having the feed roller assembled thereto, to swing within a predetermined angle around the feed roller shaft in a feed roller shaft rotation direction;

a second gear train, disposed on the frame of the ink jet printer, to be in contact with the first gear train;

a third gear train, with a front end gear connected with a rear end gear of the second gear train and a rear end gear coaxially disposed on a convey roller shaft having the convey roller assembled thereto, the third gear train swinging within a predetermined angle around a front end gear shaft, having the front end gear assembled thereto in a feed roller rotation direction; and a control unit controlling the first gear train and the second gear train to separate from each other by the entrance of the paper into the feed roller so that the driving power is blocked to the convey roller.

2. The drive apparatus of an ink jet printer according to claim 1, wherein the first gear train comprises:

a first swing arm with one end rotatably assembled on the feed roller shaft and another end provided with a protruding second gear shaft;

a first gear integrally assembled on the feed roller shaft to rotate together with the feed roller shaft; and a second gear engaged with the first gear and rotatably assembled on the second gear shaft.

3. The drive apparatus of an ink jet printer according to claim 2, wherein a friction member is disposed between a side of the second gear and the first swing arm.

4. The drive apparatus of an ink jet printer according to claim 3, wherein the friction member uses a compression spring or a curve spring.

5. The drive apparatus of an ink jet printer according to claim 1, wherein the second gear train comprises:

a third gear rotatably assembled on a third gear shaft protruding on the frame and engaged with the rear end gear of the first gear train; and a fourth gear disposed to rotate in engagement with the third gear.

6. The drive apparatus of an ink jet printer according to claim 1, wherein the third gear train comprises:

a second swing arm with one end rotatably assembled on the convey roller shaft with the convey roller assembled and another end provided with a protruding fifth gear shaft;

a sixth gear integrally assembled on the convey roller shaft to rotate together; and a fifth gear assembled to rotate on the fifth gear shaft and be engaged with the sixth gear and receiving a rotation force from the rear end gear of the second gear train.

7. The drive apparatus of an ink jet printer according to claim 6, wherein a friction member is disposed between a side of the sixth gear and the second swing arm.

8. The drive apparatus of an ink jet printer according to claim 6, further comprising a seventh gear engaged with the rear end gear of the third gear train when the convey roller comes in contact with the pinch roller thereby conveying the sheet of paper to the feed roller.

9. The drive apparatus of an ink jet printer according to claim 8, wherein a friction member is disposed on a side of the seventh gear.

10. The drive apparatus of an ink jet printer according to claim 1, wherein the third gear train comprises:

a plurality of supporting arms rotatably supporting both ends of a convey roller shaft of the convey roller;

an extension shaft connecting the plurality of supporting arms;

a front end gear rotatably assembled at one end of the extension shaft and engaged with the rear end gear of the second gear train; and a rear end gear integrally assembled on the convey roller shaft to rotate together.

11. A drive apparatus of an ink jet printer in which a sheet of paper stacked in a paper feed cassette is picked up by a pickup roller, conveyed by a convey roller and a pinch roller, and then printed by a printer head while being line-fed by a feed roller, the drive apparatus comprising:

a motor;

a reduction gear to reduce speed of the motor;

a feed gear disposed at one side of a feed roller shaft with the feed roller assembled and engaged with the reduction gear;

a plurality of first gear trains disposed on both sides of the feed roller shaft, the plurality of first gear trains swinging within a predetermined angle around the feed roller shaft in a feed roller shaft rotation direction;

a plurality of second gear trains engaged with a rear end gear of the plurality of first gear trains to transmit a rotation force of the feed roller shaft;

a plurality of third gear trains, including a front end gear, with one end connected with a rear end gear of the plurality of second gear trains and another end coaxially connected with a convey roller shaft with the convey roller assembled, the plurality of third gear trains swinging within a predetermined angle on a front end gear shaft with the front end gear assembled in a feed roller rotation direction;

a pickup shaft integrally assembled on a front end gear of the plurality of the second gear train to rotate together; and a pickup roller unit with one end assembled on the pickup shaft and the other end pressing upper surface of sheets of paper stacked in the paper feed cassette, wherein when the feed roller rotates in a direction in which the sheet of paper is conveyed to the printer head, the first gear trains separate off the second gear trains thereby preventing the pickup roller unit from rotating, and the convey roller coaxially connected with the front end gear of the third gear trains pivots downward on the front end gear shaft of the third gear trains thereby being separated off the pinch roller.

12. The drive apparatus of an ink jet printer according to claim 11, wherein at least one of the first gear trains comprises:

a first swing arm with one end rotatably assembled on the feed roller shaft and another end provided with a protruding second gear shaft;

a first gear integrally assembled on the feed roller shaft to rotate together with the feed roller shaft; and a second gear engaged with the first gear and rotatably assembled on the second gear shaft.

13. The drive apparatus of an ink jet printer according to claim 12, wherein a friction member is disposed between a side of the second gear and the first swing arm.

14. The drive apparatus of an ink jet printer according to claim 13, wherein the friction member uses a compression spring or a curve spring.

15. The drive apparatus of an ink jet printer according to claim 11, wherein at least one of the second gear trains comprises:

a third gear rotatably assembled on a third gear shaft protruding on the frame and engaged with the rear end gear of one of the first gear trains; and a fourth gear disposed to rotate in engagement with the third gear.

16. The drive apparatus of an ink jet printer according to claim 11, wherein at least one of the third gear trains comprises:

a second swing arm with one end rotatably assembled on the convey roller shaft with the convey roller assembled and another end provided with a protruding fifth gear shaft;

a sixth gear integrally assembled on the convey roller shaft to rotate together; and a fifth gear assembled to rotate on the fifth gear shaft and be engaged with the sixth gear and receiving a rotation force from the rear end gear of the second gear train.

17. The drive apparatus of an ink jet printer according to claim 16, wherein a friction member is disposed between a side of the sixth gear and the second swing arm.

18. The drive apparatus of an ink jet printer according to claim 16, further comprising a seventh gear engaged with the rear end gear of the at least one of the third gear trains when the convey roller comes in contact with the pinch roller thereby conveying the sheet of paper to the feed roller.

19. The drive apparatus of an ink jet printer according to claim 18, wherein a friction member is disposed on a side of the seventh gear.

20. The drive apparatus of an ink jet printer according to claim 11, wherein at least one of the third gear trains comprises:

a plurality of supporting arms rotatably supporting both ends of a convey roller shaft of the convey roller;

an extension shaft connecting the plurality of supporting arms;

a front end gear rotatably assembled at one end of the extension shaft and engaged with the rear end gear of the second gear train; and a rear end gear integrally assembled on the convey roller shaft to rotate together.

21. A drive apparatus of an ink jet printer in which a driving power is supplied such that a sheet of paper, stacked in a paper feed cassette, is picked up by a pickup roller, conveyed by a convey roller and a pinch roller, and then printed by a printer head while being line-fed by a feed roller on a feed roller shaft, comprising:

a first gear train, including a rear end gear, driven to rotate around the feed roller shaft in first and second directions;

a second gear train, including a rear end gear, on a frame of the ink jet printer to contact the first gear train and to transmit the driving power;

a third gear train, including a front end gear, connected with the rear end gear of the second gear train and a rear end gear coaxially disposed on a convey roller shaft, driven to rotate around a front end gear shaft in the first and second directions; and a control unit controlling the rotation direction of the first gear train to cause the first gear train to separate from the second gear train, thereby blocking transmission of the driving power to the second gear train.

22. The drive apparatus of an ink jet printer according to claim 21, wherein the first gear train comprises:

a first swing arm with one end rotatably assembled on the feed roller shaft and another end provided with a protruding second gear shaft;

a first gear integrally assembled on the feed roller shaft to rotate with the feed roller shaft; and a second gear engaged with the first gear and rotatably assembled on the second gear shaft.

23. The drive apparatus of an ink jet printer according to claim 22, wherein a friction member is disposed between a side of the second gear and the first swing arm.

24. The drive apparatus of an ink jet printer according to claim 23, wherein the friction member uses a compression spring or a curve spring.

25. The drive apparatus of an ink jet printer according to claim 21, further comprising a third gear shaft wherein the second gear train comprises:

a third gear rotatably assembled on the third gear shaft to protrude on the frame and to engage with the rear end gear of the first gear train; and a fourth gear disposed to rotate in engagement with the third gear.

26. The drive apparatus of an ink jet printer according to claim 21, further comprising a convey roller shaft having the convey roller assembled thereto and a fifth gear shaft, wherein the third gear train comprises:

a second swing arm, having one end rotatably assembled on the convey roller shaft and the other end provided with a protruding fifth gear shaft;

a sixth gear integrally assembled on the convey roller shaft to rotate; and a fifth gear assembled to rotate on the fifth gear shaft to be engaged with the sixth gear, and to receive a rotation force from the rear end gear of the second gear train.

27. The drive apparatus of an ink jet printer according to claim 26, wherein a friction member is disposed between a side of the sixth gear and the second swing arm.

28. The drive apparatus of an ink jet printer according to claim 26, further comprising a seventh gear engaged with the rear end gear of the third gear train when the convey roller comes in contact with the pinch roller thereby conveying the sheet of paper to the feed roller.

29. The drive apparatus of an ink jet printer according to claim 28, wherein a friction member is disposed on a side of the seventh gear.

30. The drive apparatus of an ink jet printer according to claim 21, further comprising a convey roller shaft having the convey roller attached thereto, wherein the third gear train comprises:

a plurality of supporting arms rotatably supporting both ends of the convey roller shaft;

an extension shaft connecting the plurality of supporting arms; and a front end gear rotatably assembled at one end of the extension shaft and engaged with the rear end gear of the second gear train, wherein the rear end gear is integrally assembled on the convey roller shaft to rotate the convey roller shaft.

31. A method of alternatively distributing power to pickup and convey rollers and a feed roller in a drive apparatus, including a motor, of an ink jet printer, the method comprising:

controlling the motor rotation to transmit a first rotation force to the pickup and convey rollers, in accordance with a first command;

reversing the motor rotation to transmit a second rotation force to the feed roller such that the first rotation force is no longer transferred to the pickup and convey rollers, at a predetermined time;

operating the feed roller; and determining whether a second command has issued, when the operating of the feed roller ends.

32. The method according to claim 31, wherein the operating comprises line-feeding a sheet of paper through the feed roller.

* * * * *